US007856757B2

(12) United States Patent
Ozawa

(10) Patent No.: US 7,856,757 B2
(45) Date of Patent: Dec. 28, 2010

(54) SASH WINDOW ASSEMBLY

(75) Inventor: Akio Ozawa, Tokyo (JP)

(73) Assignee: YKK AP, Inc., Tokyo (JP)

( * ) Notice: Subject to any disclaimer, the term of this patent is extended or adjusted under 35 U.S.C. 154(b) by 426 days.

(21) Appl. No.: 11/656,902

(22) Filed: Jan. 23, 2007

(65) Prior Publication Data

US 2007/0186478 A1 Aug. 16, 2007
US 2009/0223130 A2 Sep. 10, 2009

(30) Foreign Application Priority Data

Jan. 31, 2006 (JP) ..... 2006-023299

(51) Int. Cl.
*E05C 1/08* (2006.01)

(52) U.S. Cl. ..... 49/176; 49/181; 49/183; 292/DIG. 20; 292/DIG. 47; 292/163

(58) Field of Classification Search ..... 49/176, 49/181, 184, 185, 183; 292/137, 163, 169, 292/302, 175, 150, 146, DIG. 20, DIG. 47
See application file for complete search history.

(56) References Cited

U.S. PATENT DOCUMENTS 1,106,760 A * 8/1914 Weaver ..... 292/169.21
1,125,696 A * 1/1915 Kukta ..... 292/163
2,136,539 A * 11/1938 Brinton ..... 292/163
4,791,756 A * 12/1988 Simpson ..... 49/175
5,127,685 A * 7/1992 Dallaire et al. ..... 292/175
5,139,291 A 8/1992 Schultz
5,669,639 A * 9/1997 Lawrence ..... 292/175
6,155,615 A * 12/2000 Schultz ..... 292/163
6,183,024 B1 * 2/2001 Schultz et al. ..... 292/175
6,485,070 B1 * 11/2002 Schultz ..... 292/175
6,546,671 B2 * 4/2003 Mitchell et al. ..... 49/185
6,722,712 B2 * 4/2004 Schultz ..... 292/175
6,832,792 B2 * 12/2004 Polowinczak et al. ..... 292/36
6,845,593 B2 * 1/2005 Silverman ..... 52/655.1
6,948,278 B1 * 9/2005 Schultz ..... 49/185
2006/0207181 A1 * 9/2006 Polowinczak et al. ..... 49/185

FOREIGN PATENT DOCUMENTS

JP A-2003-49573 2/2003

* cited by examiner

*Primary Examiner*—Katherine W Mitchell
*Assistant Examiner*—Daniel Cahn
(74) *Attorney, Agent, or Firm*—Alston & Bird LLP

(57) ABSTRACT

A sash window assembly includes: a window frame having upper, lower, and left and right vertical frame members; and at least one sash guided by the vertical frame members and supported to be openable and closable by being slid vertically. The sash has: latch devices provided respectively at left and right ends in an upper end portion of the sash; an upper frame element having first passage holes formed in a top surface thereof and through which respective operating members of the respective latch devices are exposed toward an indoor space; a lower frame element; left and right vertical frame elements, each having a second passage hole formed in a depth-direction surface of the vertical frame element and through which a fastening section of the latch device is passed; and a face material provided inside the upper, lower, and left and right vertical frame elements.

4 Claims, 9 Drawing Sheets

SASH WINDOW ASSEMBLY

CROSS-REFERENCE TO RELATED APPLICATIONS

The present application claims priority upon Japanese Patent Application No. 2006-023299 filed on Jan. 31, 2006, which is herein incorporated by reference.

BACKGROUND OF THE INVENTION

1. Technical Field

The present invention relates generally to sash window assemblies, and particularly to such a sash window assembly having a latch device incorporated in a vertically slidable, inwardly tiltable sash.

2. Related Art

Vertically-sliding windows having vertically openable/closable, inwardly-tiltable sashes are known that are mounted in openings of exterior walls of housings, for example. For such windows, there have been proposed latch devices that fasten an upper portion of the sash to a vertical frame member of a window frame with respect to the depth direction and vertically guide the sash, and that support the sash such that it can be operated so as to tilt inward when the fastening is released. (See, for example, JP-A-2003-49573, U.S. Pat. No. 5,139,291, and U.S. Pat. No. 6,183,024.)

The latch devices disclosed in the above-mentioned references are made up of a case, an engaging member that is accommodated in the case and that projects toward the vertical frame member, a spring that urges the engaging member in the projecting direction, and an operating member that is operated for retracting the engaging member into the case against the urging force of the spring. The latch devices are mounted respectively to intersecting portions where an upper frame element (a mating frame element) of the sash and the two vertical frame elements thereof intersect, the intersecting portions being located at both left and right ends in the upper portion of the sash. An indentation is formed in each intersecting portion where one of the lateral end portions of the upper frame element and the upper end portion of one of the vertical frame elements intersect, and each latch device is fixed to the sash by inserting the case into the indentation and then fastening the case with screws etc. More specifically, as shown in FIG. 2 of U.S. Pat. No. 5,139,291 and FIG. 14 of U.S. Pat. No. 6,183,024, the indentation is formed in the intersecting portion of the upper frame element and the vertical frame element in such a manner that the indentation is opened contiguously across the top surface of the upper frame element and the depth-direction surface of the vertical frame element, and the latch device is mounted by being slid along the indentation in the lateral direction from the side of the vertical frame element.

However, with the conventional latch devices such as those disclosed in the above-mentioned references, it is necessary to form a large indentation extending across the intersecting portion of the upper frame element and the vertical frame element for inserting the case, and this gives rise to a problem that the strength of the sash is reduced or that it becomes necessary to provide reinforcement measures for preventing this strength reduction. More specifically, it is the engaging member of the latch device that restricts the upper end portion of the sash from moving toward the indoor side, and thus, when force such as outdoor wind pressure is applied to the sash from the out-of-plane direction, the force is transmitted from the upper frame element and the vertical frame element to the vertical frame member through the case and the engaging member. At that time, the case may break open the indentation at the intersecting portion between the upper frame element and the vertical frame element, and the indentation may deform so as to open up. Such deformation reduces the strength in the periphery of the indentation, and this strength reduction negatively affects the performance (strength, hermeticity, watertightness, etc.) of the sash window assembly.

SUMMARY

An advantage achieved by some aspects of the present invention is that it is possible to provide a sash window assembly with which it is possible to sufficiently ensure the strength of a sash without providing extensive reinforcements.

A primary aspect of the invention is a sash window assembly including:

a window frame having an upper frame member, a lower frame member, and left and right vertical frame members; and at least one sash that is guided by the vertical frame members and supported so as to be openable and closable by being slid vertically, the sash having latch devices provided respectively at left and right ends in an upper end portion of the sash, each latch device having a fastening member that is movably supported so as to project and retract between a fastened position in which the fastening member is fastened to the vertical frame member and guided so as to slide vertically, and an unfastened position in which the fastening between the fastening member and the vertical frame member is released, and an operating member that is operated to move the fastening member, an upper frame element having first passage holes that are formed in a top surface of the upper frame element and through which the respective operating members of the respective latch devices are exposed toward an indoor space, a lower frame element, left and right vertical frame elements, each vertical frame element having a second passage hole that is formed in a depth-direction surface of the vertical frame element and through which the fastening member is passed, and a face material that is provided inside a framing made by assembling the upper frame element, the lower frame element, and the left and right vertical frame elements such that these frame elements constitute the four sides of the framing, the sash being structured so as to be turnable toward the indoor side about a lower end portion thereof by operating the operating member and moving the fastening member to the unfastened position.

Other features of the present invention will be made clear through the description of the present specification with reference to the accompanying drawings.

DESCRIPTION OF EXEMPLARY EMBODIMENTS

Figure 1:
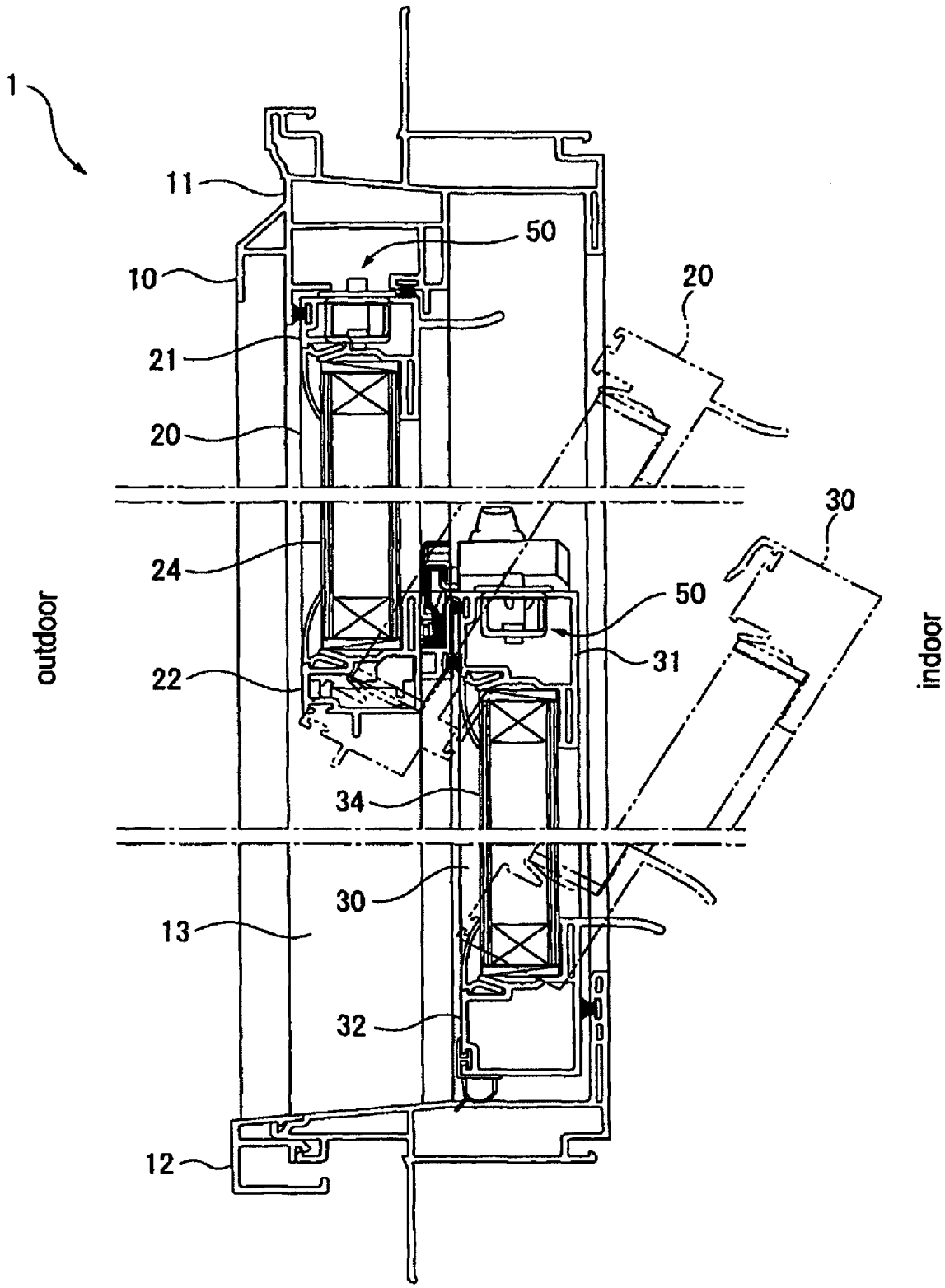
FIG. 1 is a vertical sectional view showing a sash window assembly according to a first embodiment of the present invention.

At least the following matters will be made clear by the explanation in the present specification and the description of the accompanying drawings.

According to a primary aspect of the invention, a sash window assembly includes:

a window frame having an upper frame member, a lower frame member, and left and right vertical frame members; and at least one sash that is guided by the vertical frame members and supported so as to be openable and closable by being slid vertically, the sash having latch devices provided respectively at left and right ends in an upper end portion of the sash, each latch device having a fastening member that is movably supported so as to project and retract between a fastened position in which the fastening member is fastened to the vertical frame member and guided so as to slide vertically, and an unfastened position in which the fastening between the fastening member and the vertical frame member is released, and an operating member that is operated to move the fastening member, an upper frame element having first passage holes that are formed in a top surface of the upper frame element and through which the respective operating members of the respective latch devices are exposed toward an indoor space, a lower frame element, left and right vertical frame elements, each vertical frame element having a second passage hole that is formed in a depth-direction surface of the vertical frame element and through which the fastening member is passed, and a face material that is provided inside a framing made by assembling the upper frame element, the lower frame element, and the left and right vertical frame elements such that these frame elements constitute the four sides of the framing, the sash being structured so as to be turnable toward the indoor side about a lower end portion thereof by operating the operating member and moving the fastening member to the unfastened position.

The openable-and-closable sash (movable sash) may be structured as vertically-paired sashes (an upper sash and a lower sash) (i.e., structured as a double-hung window), or it may be structured of a single sash (i.e., structured as a single-hung window), or it may be structured of three or more sashes. Further, in addition to the movable sash, the sash window assembly may be furnished with fixed sashes and fixed face materials, for example.

With such a sash window assembly, by passing the fastening member through the second passage hole to make the fastening member project toward the vertical frame member as well as making the operating member be exposed through the first passage hole toward the indoor space, it becomes possible to mount the latch devices respectively to both the left and right ends in the upper end portion of the sash and allow the latch devices to function, without forming a large indentation across the intersecting portion between the upper frame element and the vertical frame element of the sash. Since no large indentation is necessary, it becomes possible to sufficiently ensure the strength of the sash without providing extensive reinforcements.

Further, in the above-mentioned sash window assembly, it is preferable that the latch device has a latch body having the fastening member, an urging member that urges the fastening member toward the fastened position, and a case member that guides the fastening member, and a supporting element that mates with the latch body and that is capable of supporting the case member; and the supporting element is inserted from the first passage hole, the latch body is inserted from the second passage hole, and the supporting element and the latch body mate with one another inside the frame element.

According to this structure, the latch device is divided into the latch body and the supporting element, and the latch device is mounted by passing the supporting element through the first passage hole, passing the latch body through the second passage hole, and making the supporting element and the latch body mate with one another inside the frame element. Thus, the tasks for mounting and assembling the latch device can be carried out with ease, even without providing a large indentation at the intersecting portion between the upper frame element and the vertical frame element.

Further, in the above-mentioned sash window assembly, it is preferable that the supporting element of the latch device has formed therein a guide hole for guiding the operating member; and in a state where the latch body is passed through the second passage hole, the supporting element is passed through the first passage hole, and the supporting element and the latch body are made to mate with one another, the operating member passes through the guide hole of the supporting element and is fixed to the fastening member.

According to this structure, since the operating member is fixed to the fastening member in a state where the latch body and the supporting element are made to mate with one another, the latch body will not fall out from the supporting element and the mounted state can be maintained without fixing the latch body and the supporting element together with screws, etc. Thus, it is possible to facilitate the mounting tasks, and the exterior design of the latch device can be improved.

Further, in the above-mentioned sash window assembly, it is preferable that the fastening member is positioned in the fastened position by engaging with the case member at the fastened position.

According to this structure, the latch body can be inserted from the second passage hole and be made to mate with the supporting element in a state where the fastening member is positioned with respect to the case member and the latch body is thereby assembled. Thus, the workability for mounting the latch device to the sash can be improved.

Further, in the above-mentioned sash window assembly, it is preferable that the case member is formed having an engaging portion that engages with an edge of the second passage hole.

According to this structure, the engaging portion engages with the edge of the second passage hole when the latch body is inserted from the second passage hole. Thus, the latch body can be fixed to the sash without being fastened with screws, and the mounting task can be made more efficient.

On the other hand, in the above-mentioned sash window assembly according to a second embodiment, the latch device may have the fastening member, an urging member urging the fastening member toward the fastened position, a case member for guiding the fastening member, and a cover member for supporting the case member and having formed therein a guide hole through which the operating member is passed, the fastening member normally projecting from the second passage hole, the case member being inserted from the first passage hole, the cover member being fixed to the upper frame element.

According to this structure, the latch device is mounted by first inserting the case member from the first passage hole, then making the fastening member project from the second passage hole, and finally fixing the cover member to the upper frame element. Thus, the tasks for mounting the latch device can be carried out with ease, even without providing a large indentation at the intersecting portion between the upper frame element and the vertical frame element.

Further, in the above-mentioned sash window assembly, it is preferable that the cover member is fixed to the upper frame element by an elastically-deformable engaging member, or by being fastened with a screw.

According to the above, the structure for attaching the cover member to the upper frame element can appropriately be selected from either fixing using the engaging member or fixing using screws. In particular, fixing using the elastically-deformable engaging member allows to further facilitate the tasks for mounting the latch device.

Further, in the above-mentioned sash window assembly, it is preferable that the first passage hole is provided at a position located away from an end, in a longitudinal direction, of the upper frame element; and the second passage hole is provided at a position located away from an upper end of the vertical frame element.

According to another primary aspect of the invention, a sash window assembly includes:

a window frame having an upper frame member, a lower frame member, and left and right vertical frame members; and at least one sash that is guided by the vertical frame members and supported so as to be openable and closable by being slid vertically, the sash having latch devices provided respectively at left and right ends in an upper end portion of the sash, each latch device having a fastening member that is movably supported so as to project and retract between a fastened position in which the fastening member is fastened to the vertical frame member and guided so as to slide vertically, and an unfastened position in which the fastening between the fastening member and the vertical frame member is released, and an operating member that is operated to move the fastening member, a framing having an upper frame element, a lower frame element, and left and right vertical frame elements, the framing having first passage holes that are formed in a top surface of the framing and through which the respective operating members of the respective latch devices are exposed toward an indoor space, the framing having second passage holes that are formed respectively in depth-direction surfaces of the framing and through which the respective fastening members of the respective latch devices are passed, and a face material that is provided inside the framing, the sash being structured so as to be turnable toward the indoor side about a lower end portion thereof by operating the operating member and moving the fastening member to the unfastened position.

According to this structure, the tasks for mounting and assembling the latch device can be carried out with ease, even without providing a large indentation at the intersecting portion between the upper frame element and the vertical frame element.

EXEMPLARY EMBODIMENTS

Below, embodiments of the present invention are described with reference to the drawings.

Note that, as for the second and subsequent embodiments, structural components that are the same as or have similar functions as those of the first embodiment described below are assigned the same reference characters as those of the first embodiment, and explanation thereof is omitted or simplified. Further, in the figures, hatchings for indicating cross-sections of primary structural components may be omitted in some cases.

First Embodiment

Figure 2:
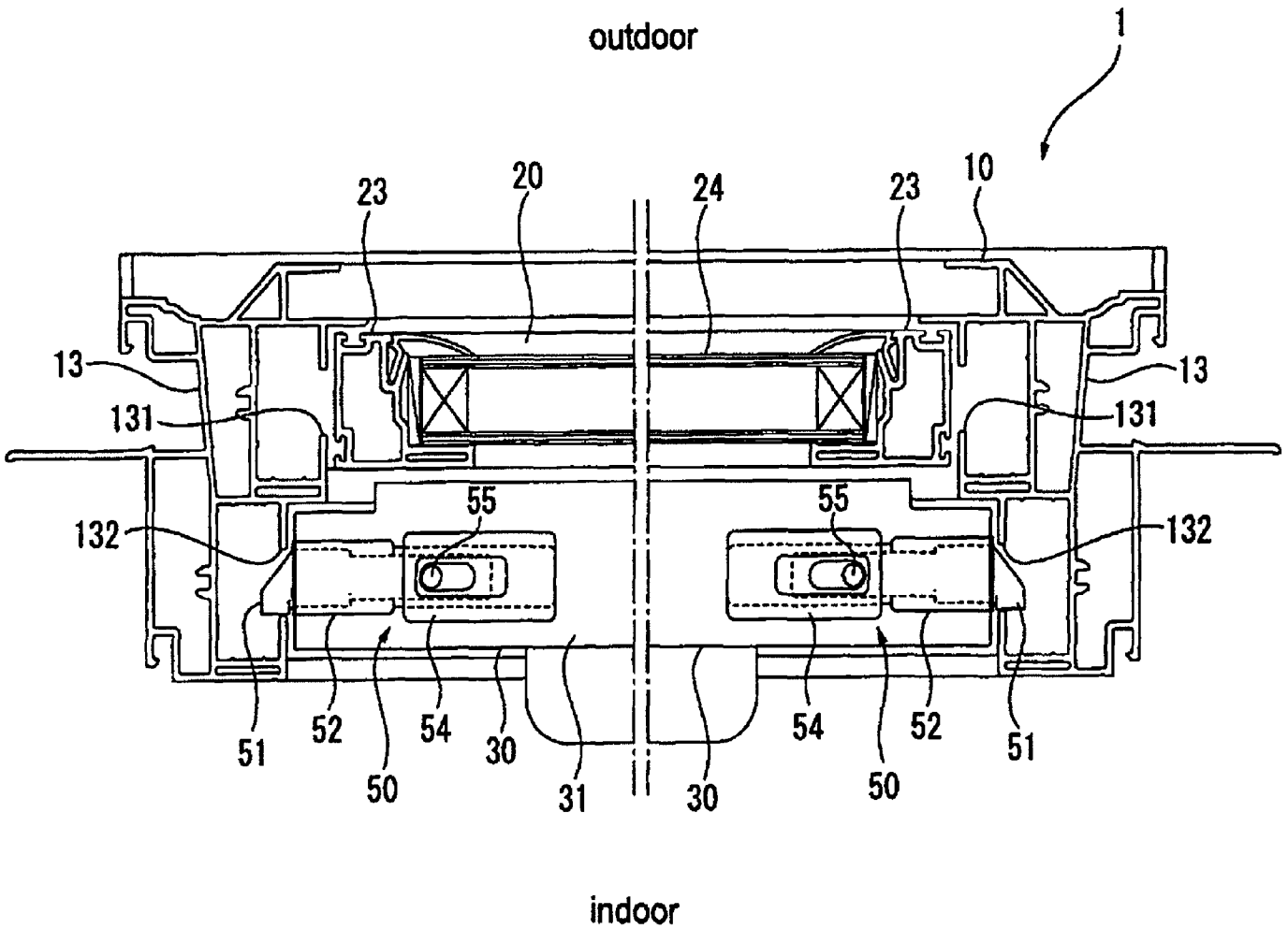
FIG. 2 is a horizontal sectional view showing the sash window assembly.
Figure 3B:
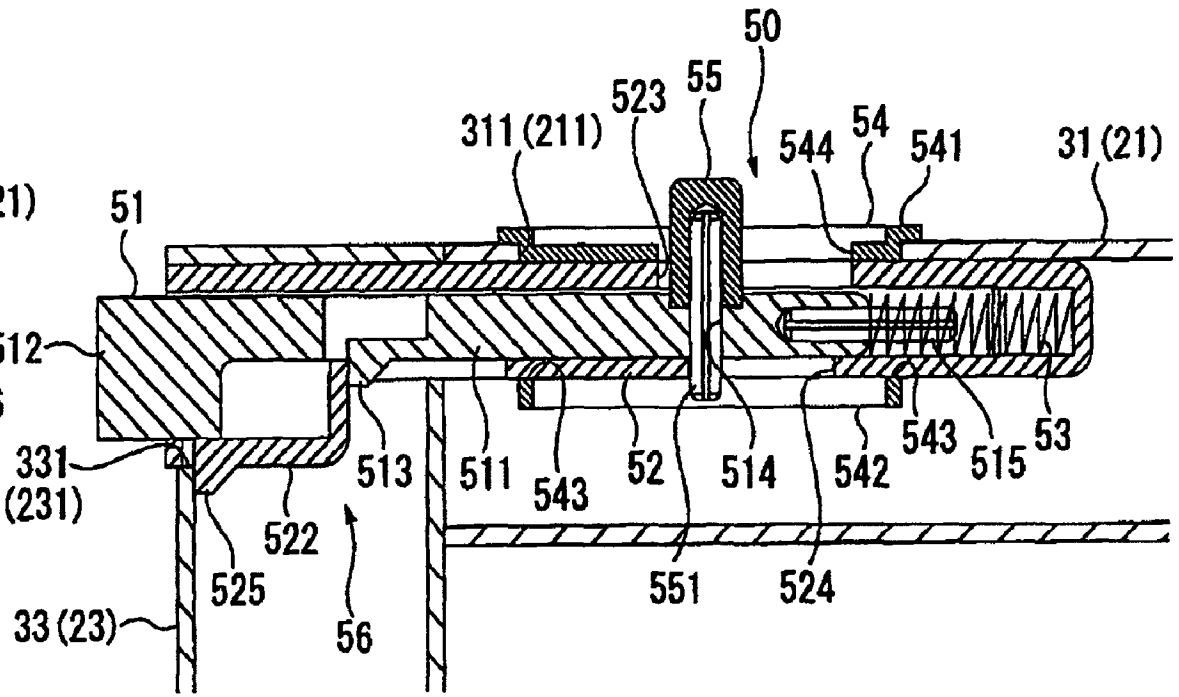
FIGS. 3A and 3B are sectional views showing in magnification a portion of a sash in the sash window assembly.
Figure 3A:
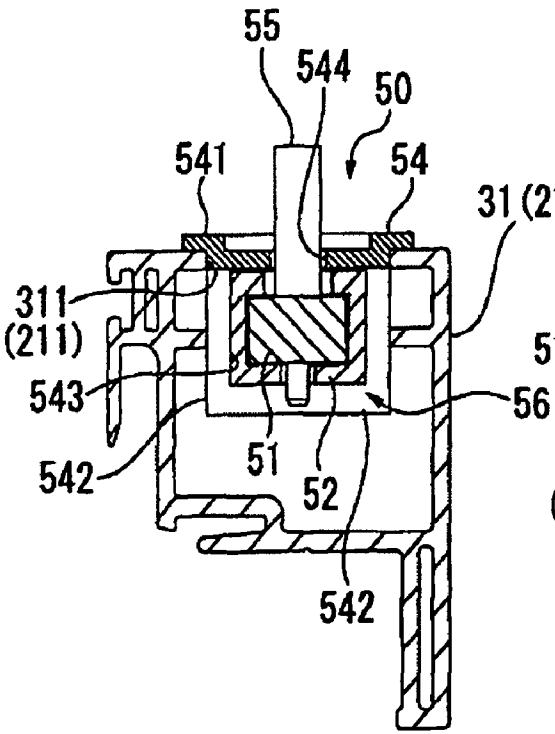
Figure 4:
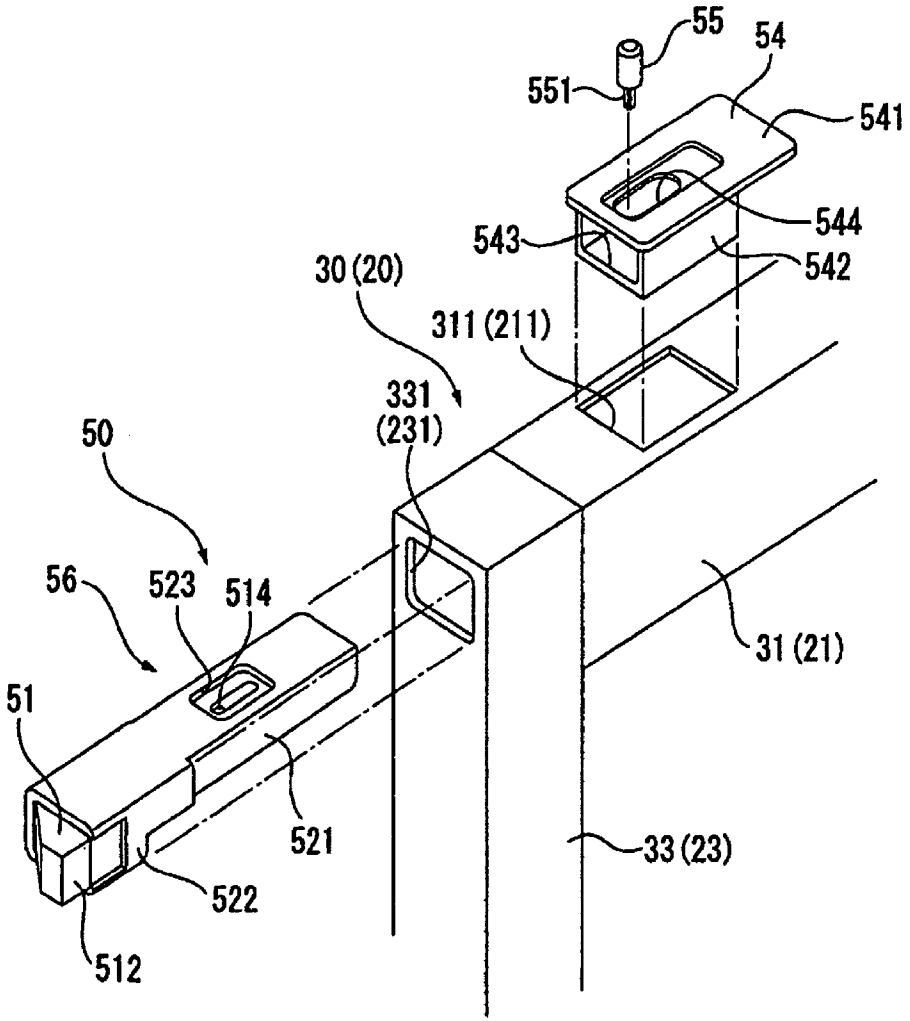
FIG. 4 is a perspective view showing a latch device mounted to the sash.
Figure 5:
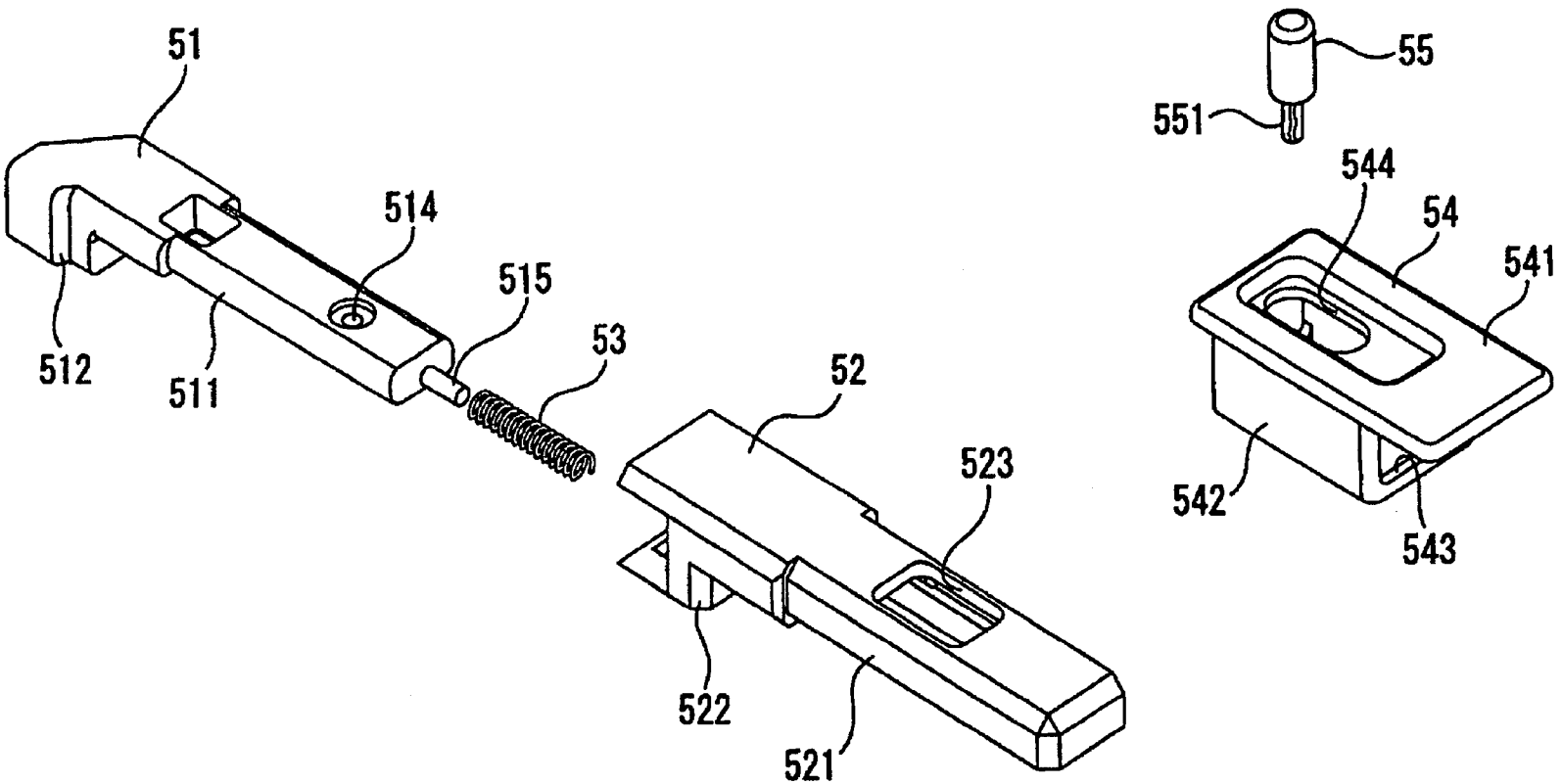
FIG. 5 is an exploded perspective view showing the latch device.

FIG. 1 is a vertical sectional view showing a vertically-sliding window 1 which is an example of a sash window assembly according to the first embodiment of the present invention. FIG. 2 is a horizontal sectional view showing the vertically-sliding window 1. FIGS. 3A and 3B are sectional views showing in magnification a portion of sashes 20 and 30 of the vertically-sliding window 1. FIG. 4 is a perspective view showing a latch device 50 mounted to the sashes 20 and 30. FIG. 5 is an exploded perspective view showing the latch device 50.

As shown in FIGS. 1 and 2, the vertically-sliding window 1 is provided in an opening in an exterior wall of a building such as a stand-alone house. The window 1 is a so-called double-hung vertically-sliding window and is made up of a window frame 10 that is fixed to the opening of the exterior wall, and an upper sash 20 (outdoor-side sash) and a lower sash 30 (indoor-side sash) that are supported within the window frame 10 such that they can be opened and closed by being slid vertically.

The window frame 10 is formed by assembling an upper frame member (head) 11, a lower frame member (sill) 12, and lateral (right and left) vertical frame members (jambs) 13 such that they constitute the four sides of the frame. Each vertical frame member 13 has guide grooves 131 and 132 that guide the upper sash 20 and the lower sash 30, respectively. A not-shown balancer for urging the upper sash 20 and the lower sash 30 upward is provided in the upper frame member 11 or the vertical frame member 13. The upper sash 20 is formed by assembling together an upper frame element (top rail) 21, a lower frame element (bottom rail) 22, and lateral (right and left) vertical frame elements (stiles) 23, which are made of aluminum extrusions or resin, such that they constitute the four sides of a framing and fitting a glass panel 24 inside the framing. The lower sash 30 is formed similarly, that is, by assembling together an upper frame element 31, a lower frame element 32, and lateral (right and left) vertical frame elements 33, which are made of aluminum extrusions or resin, such that they constitute the four sides of a framing and fitting a glass panel 34 inside the framing. The upper and lower sashes 20 and 30 have slide shoes (not shown) provided on their lower frame elements 22 and 32 and the lower end portions of their vertical frame elements 23 and 33, and these slide shoes are guided by the guide grooves 131 and 132, respectively. Connecting these slide shoes to the balancer either directly or through wires etc. allows the weight of the sashes to be counterbalanced, thereby allowing the upper and lower sashes 20 and 30 to be opened and closed with small force.

Further, the upper and lower sashes 20 and 30 are turnably supported by their respective slide shoes, and as shown by phantom lines (chain double-dashed lines) in FIG. 1, the sashes 20 and 30 are structured such that they are turnable toward the indoor side (i.e., inwardly tiltable) about their lower end portions. Further, latch devices 50 are provided respectively on the left and right end portions in the upper portion of the upper and lower sashes 20 and 30. The latch devices 50 are fastened to and slidably guided by the guide grooves 131 and 132 of the vertical frame members 13 in the normal open/close state of the sashes 20 and 30, and they support the sashes 20 and 30 in an inwardly-tiltable manner once the fastening is released. Describing this more specifically, in a state where the lower sash 30 is opened slightly upward from its closed position shown in FIG. 1 and the lower frame element 32 is detached from the lower frame member 12, the lower sash 30 can be tilted inward by releasing the fastening of the latch devices 50, and in the tilted-in state, the lower sash 30 is supported by not-shown arm members connected to the vertical frame member 13, lock members provided in the slide shoes, or the like. On the other hand, the upper sash 20 can be tilted inward by releasing the fastening of the latch devices 50 in a state where the lower sash 30 is tilted inward and the upper sash 20 is opened slightly downward from its closed position shown in FIG. 1 and the upper frame element 21 is detached from the upper frame member 11. Note that, although the exemplified upper and lower sashes 20 and 30 are structured such that they are supported by the arm members, the lock members, or the like in the tilted-in state, these members do not have to be provided.

As shown in FIGS. 3 to 5, each latch device 50 is made up of: a latch bolt 51 that projects sideward from the vertical frame element 23 or 33 to be fastened to the vertical frame member 13, the latch bolt 51 serving as a "fastening member"; a case member 52 that slidably guides the latch bolt 51 so that it projects from or retracts into the case member; a helical spring 53 that urges the latch bolt 51 in the projecting direction with respect to the case member 52, the helical spring 53 serving as an "urging member"; a cover member 54 that supports the case member 52 by mating therewith, the cover member 54 serving as a "supporting element"; and a knob 55 that projects upward from the cover member 54 while being fixed to the latch bolt 51, and that is for operating the latch bolt 51 such that it projects from or retracts into the case member.

The latch bolt 51 of the latch device 50 has a rod-like portion 511 that generally has a substantially square-bar-like shape and that is inserted into the case member 52, and an enlarged portion 512 that is formed by enlarging the tip end of the rod-like portion 511. The latch bolt 51 is supported by the case member 52 such that it can move to project from or retract into the case member between a fastened position in which the enlarged portion 512 is fastened to the guide groove 131 or 132 of the vertical frame member 13 to restrict the upper sash 20 or the lower sash 30 from tilting inward, and an unfastened position in which the fastening between the enlarged portion 512 and the vertical frame member 13 is released. The latch bolt 51 is also furnished with an engaging piece 513 that is engageable to the case member 52, as shown in FIG. 3. The engaging piece 513 is structured such that it can elastically deform in the vertical direction. The engaging piece 513 bends upward and then engages with the case member 52 when the rod-like portion 511 is inserted into the case member 52 up to the fastened position, thereby preventing the latch bolt 51 from projecting beyond the fastened position. Further, a fixing hole 514 is formed in the latch bolt 51, the fixing hole 514 vertically penetrating the rod-like portion 511. A pin 551 of the knob 55 is passed through this fixing hole 514, and thereby the knob 55 is fixed to the latch bolt 51. Further, a pin 515 that is inserted into the helical spring 53 for mounting the helical spring 53 thereon is provided on the tip end of the rod-like portion 511 on the side opposite from the side of the enlarged portion 512 (on the right side in FIG. 3). Note that the pin 515 may be formed separately from the latch bolt 51 and be fixed thereto, or the pin 515 may be formed integrally as a part of the latch bolt 51.

The case member 52 has a tubular portion 521 that generally has a substantially square-tubular shape and through which the rod-like portion 511 of the latch bolt 51 can be passed, and an enlarged-diameter portion 522 that is formed on the tip-end side of the tubular portion 521 and that has an enlarged diameter such that the enlarged portion 512 of the latch bolt 51 can be passed therethrough. The case member 52 is structured such that the engaging piece 513 of the latch bolt 51 can engage to the enlarged-diameter portion 522. Further, a passage hole 523 through which the knob 55 is passed is formed in the top surface of the tubular portion 521, whereas a passage hole 524 through which the pin 551 of the knob 55 is passed is formed in the bottom surface of the tubular portion 521. These passage holes 523 and 524 are formed so as to have a length corresponding to the range of movement of the knob 55 and the pin 551 that occurs along with the projection/retraction movement of the latch bolt 51. Furthermore, as shown in FIG. 3, an engaging piece 525 that is engageable to the vertical frame element 23 or 33 is provided on the lower portion of the tip end of the enlarged-diameter portion 522 of the case member 52, the engaging piece 525 serving as an "engaging member". In a state where the case member 52 has been inserted into the second passage hole 231 or 331 (described later) of the vertical frame element 23 or 33, the engaging piece 525 engages with the lower edge of the second passage hole 231 or 331, and through this engagement, the case member 52 is fixed to the vertical frame element 23 or 33.

The helical spring 53 is placed between the tip end of the rod-like portion 511 of the latch bolt 51 and the bottom portion of the tubular portion 521 of the case member 52. In a state where the latch bolt 51 is inserted into the case member 52 and the engaging piece 513 is engaged to the enlarged-diameter portion 522 of the case member 52, the helical spring 53 maintains an urging force, which is a compression force, to urge the latch bolt 51 in the projecting direction (toward the left in FIG. 3). Accordingly, when the knob 55 is operated and the latch bolt 51 is retracted into the case member 52, the helical spring 53 is compressed and it is kept in a state where its urging force is increased, and when the operation of the knob 55 is stopped (i.e., when the user releases his/her finger from the knob 55), the enlarged portion 512 of the latch bolt 51 projects from the enlarged-diameter portion 522 of the case member 52 due to the urging force of the helical spring 53, thereby moving the latch bolt 51 to the fastened position.

The cover member 54 is formed having a top-surface portion 541 that is arranged to be exposed from the top surface of the upper frame element 21 or 31, an inserted portion 542 that extends downward from the top-surface portion 541 and that is inserted into the first passage hole 211 or 311 (described later) of the upper frame element 21 or 31, and a mating portion 543 that is provided in the inserted portion 542 and through which the tubular portion 521 of the case member 52 can be passed. Furthermore, a guide hole 544 that allows the knob 55 to be passed therethrough so as to guide the knob 55 is formed in the top-surface portion 541 of the cover member 54, the guide hole 544 being formed so as to have a length corresponding to the range of movement of the knob 55 that occurs along with the projection/retraction movement of the latch bolt 51. Passing the tubular portion 521 of the case member 52 through the mating portion 543 of the cover member 54 allows the cover member 54 and the case member 52 to mate with one another.

In the latch device 50 described above, the latch bolt 51, the case member 52, and the helical spring 53 make up a latch body 56. The latch device 50 is assembled and mounted to the respective sash 20 or 30 by making the case member 52 of the latch body 56 and the cover member 54 mate with one another inside the upper frame element 21 or 31. More specifically, as shown in FIG. 4, first passage holes 211 and 311 for passage of the inserted portion 542 of the cover member 54 are formed respectively in the top surfaces of the respective upper frame elements 21 and 31 of the upper and lower sashes 20 and 30, and second passage holes 231 and 331 for passage of the latch body 56 are formed respectively in the depth-direction surfaces of the vertical frame elements 23 and 33. The first passage holes 211 or 311 are formed in the top surface of each upper frame element 21 or 31 at positions located a predetermined distance away from the respective end portions in the longitudinal direction (left and right end portions) of the upper frame element, whereas the second passage hole 231 or 331 is formed at a position located a predetermined distance away from the upper end portion of each vertical frame element 23 or 33. In other words, the first passage hole 211, 311 and the second passage hole 231, 331 are formed such that they do not extend across the joint position, or the corner, between the upper frame element 21, 31 and the vertical frame element 23, 33.

The latch device 50 is mounted according to the following procedure. First, as shown in FIG. 5, the latch body 56 is assembled by: passing the pin 515 of the latch bolt 51 through the helical spring 53, inserting the rod-like portion 511 of the latch bolt 51 into the case member 52, and then engaging the engaging piece 513 (see FIG. 3) of the latch bolt 51 to the enlarged-diameter portion 522 of the case member 52 in a state where the helical spring 53 is pressed to the bottom portion of the tubular portion 521 of the case member 52. Then, as shown in FIG. 4, the inserted portion 542 of the cover member 54 is inserted into the first passage hole 211 or 311, and then the assembled latch body 56 is inserted into the second passage hole 231 or 331, so that the tubular portion 521 of the case member 52 is passed through the mating portion 543 of the cover member 54 and the latch body 56 and the cover member 54 mate with one another, and the engaging piece 525 of the case member 52 is engaged to the lower edge of the second passage hole 231 or 331. Then, the pin 551 of the knob 55 is inserted into the fixing hole 514 of the latch bolt 51 from above through the guide hole 544 of the cover member 54 and the passage hole 523 of the case member 52, thereby fixing the knob 55 to the latch bolt 51.

In the manner described above, the latch device 50 is mounted to the sash 20 or 30 in a state where the latch body 56 and the cover member 54 mate with one another inside the upper frame element 21 or 31. By operating the knob 55 of the mounted latch device 50, it is possible to make the enlarged portion 512 of the latch bolt 51 be retracted into the case member 52 and move the latch bolt 51 to its unfastened position, which releases the fastening between the enlarged portion 512 and the guide groove 131 or 132 of the vertical frame member 13 and allows tilt-in operation of the upper sash 20 or the lower sash 30. On the other hand, by turning the tilted-in upper sash 20 or lower sash 30 to the outdoor side, a slanted surface formed in the enlarged portion 512 of the latch bolt 51 on the outdoor side thereof is pressed by the vertical frame member 13 and the latch bolt 51 is thereby retracted into the case member 52, and when the latch device is moved to the position of the guide groove 131 or 132, the latch bolt 51 projects outward due to the urging force of the helical spring 53 and thus the enlarged portion 512 is fastened to the guide groove 131 or 132.

The following effects are attained by the present embodiment described above:

(1) The latch device 50 is structured such that it can be separated into the latch body 56 and the cover member 54, and such that the cover member 54 can be passed through the first passage hole 211 or 311, the latch body 56 can be passed through the second passage hole 231 or 331, and thereafter the cover member 54 and the latch body 56 can mate with one another inside the frame element. As a result thereof, it is not necessary to form a large indentation extending across the intersecting portion (the joint portion or the end portions of the frame elements) between the upper frame element 21 or 31 and the vertical frame element 23 or 33 of the respective upper sash 20 or the lower sash 30, and therefore, it is possible to ensure sufficient strength of the sashes. Accordingly, even when extremely strong wind pressure or impact is applied to the upper and lower sashes 20 and 30 during rainstorms such as typhoons, the sashes 20 and 30 can be prevented from deforming or falling off, and can be supported due to the wind pressure or impact being reliably transmitted from the upper frame elements 21 and 31 and the vertical frame elements 23 and 33 to the vertical frame members 13 through the case members 52 and the latch bolts 51 of the respective latch devices 50.

(2) Furthermore, by simply inserting the pin 551 of the knob 55 into the fixing hole 514 of the latch bolt 51 to fix the knob 55 to the latch bolt 51 in a state where the latch body 56 and the cover member 54 mate with one another, the latch body 56 can be kept from coming off from the cover member 54, and thus, the mounted state of the latch device can be maintained without using screws etc. to fix the latch body 56. Therefore, it is possible to facilitate the mounting tasks, and the exterior design of the latch device 50 can be improved because screws etc. do not appear outside.

(3) Furthermore, the engaging piece 525 of the case member 52 is made to engage with the lower edge of the second passage hole 231 or 331 when the latch body 56 is inserted from the second passage hole 231 or 331. This enables the latch body 56 to be fixed without using screws, and therefore, it is possible to make the mounting tasks more efficient and to further improve the exterior design.

(4) Furthermore, the latch bolt 51 is positioned in its fastened position by the engaging piece 513 of the latch bolt 51 being engaged to the enlarged-diameter portion 522 of the case member 52. Therefore, the latch body 56, which is already in its assembled state, can be inserted from the second passage hole 231 or 331 and mate with the cover member 54. Such a configuration allows the workability for mounting the latch device 50 to be further improved.

(5) Furthermore, the latch bolt 51 is structured to have the enlarged portion 512, and the case member 52 is structured to have the enlarged-diameter portion 522. With this structure, force such as wind pressure that is applied from the outdoor side to the sash 20 or 30 when the enlarged portion 512 is fastened to the guide groove 131 or 132 of the vertical frame member 13 can reliably be supported by the enlarged portion 512 and the enlarged-diameter portion 522 and be transmitted to the vertical frame member 13 thereby.

Second Embodiment

Figure 7:
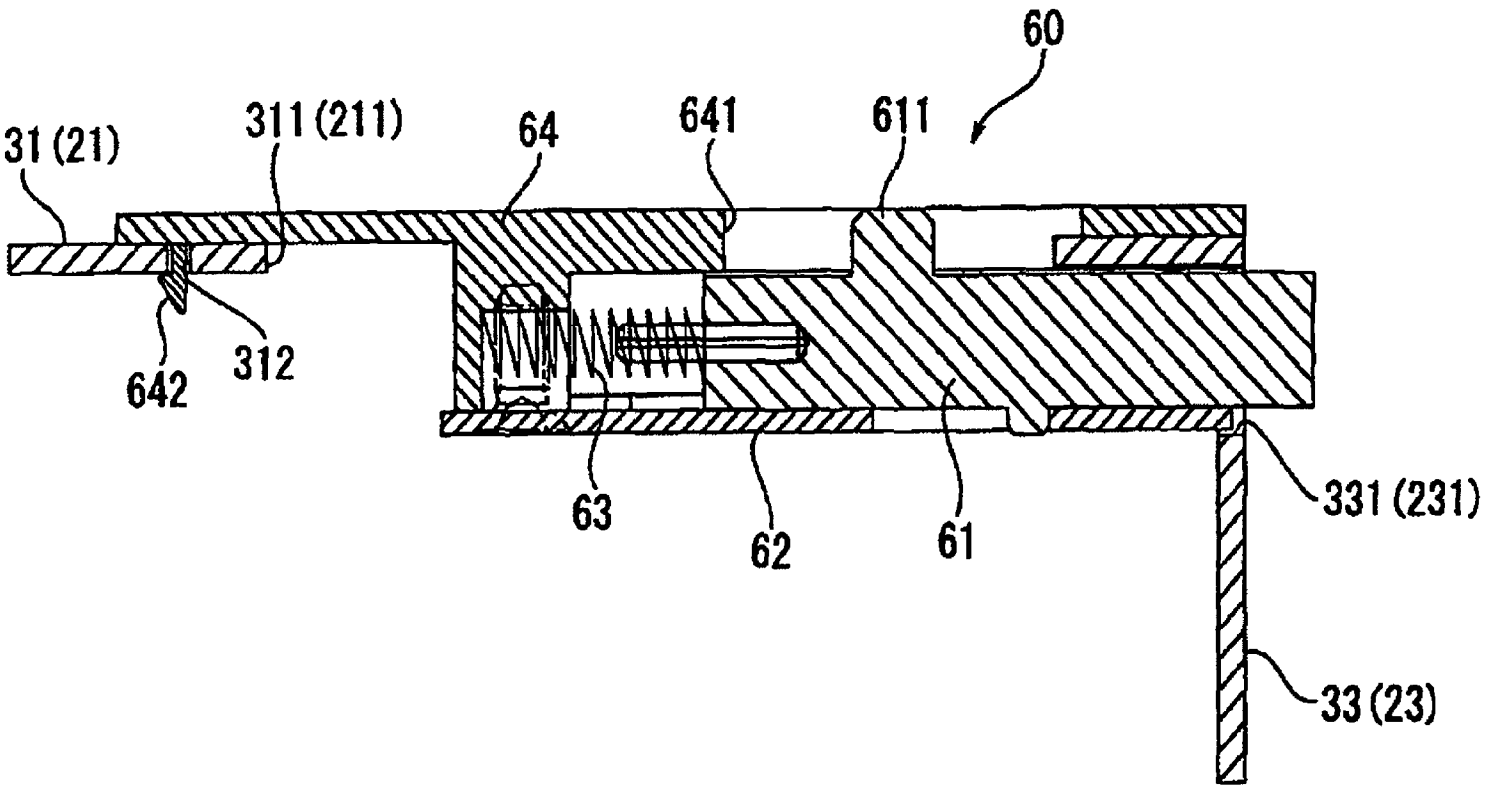
FIG. 7 is a sectional view showing in magnification a portion of the sash.
Figure 8:
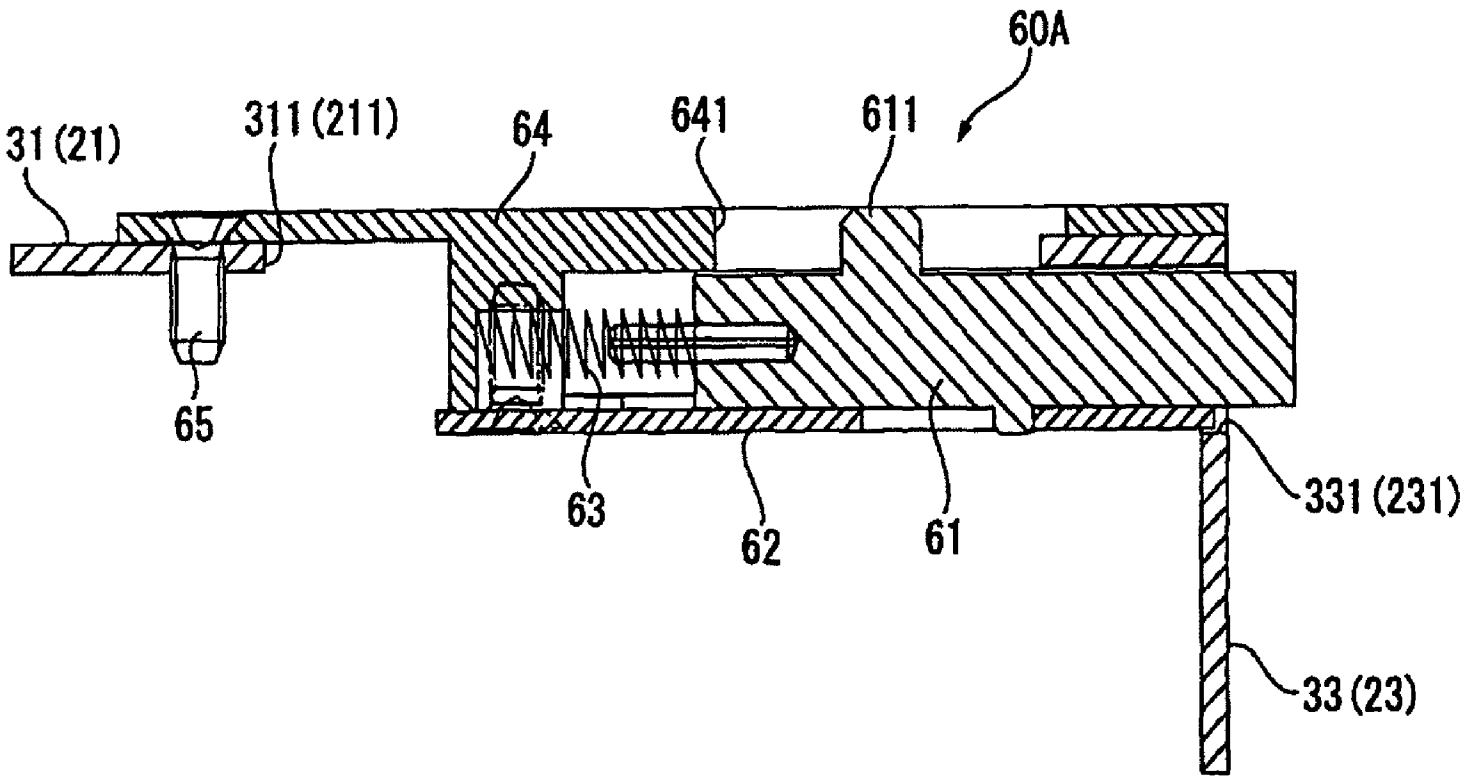
FIG. 8 is a sectional view showing another form of a latch device of the second embodiment.

Next, latch devices 60 and 60A of a sash window assembly according to the second embodiment of the present invention are described with reference to FIGS. 6 to 8.

Figure 6:
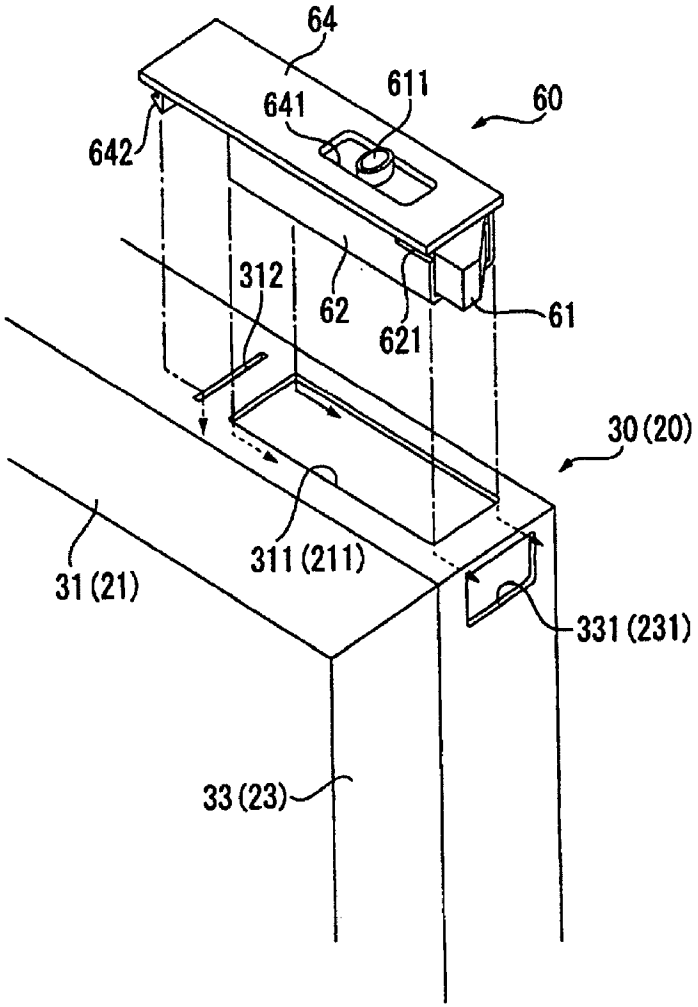
FIG. 6 is a perspective view showing a portion of a sash in a sash window assembly according to a second embodiment of the present invention.

FIG. 6 is a perspective view showing a portion of a sash 30 in a sash window assembly of the second embodiment. FIG. 7 is a sectional view showing in magnification a portion of the sash 30, and is a sectional view showing a latch device 60. FIG. 8 is a sectional view showing in magnification a portion of the sash 30 to which a latch device 60A different from the one shown in FIG. 7 is mounted.

The latch devices 60 and 60A according to the second embodiment differ from the latch device 50 of the first embodiment in terms that the latch devices 60 and 60A are not structured to be separable into the latch body 56 and the cover member 54 as with the latch device 50 of the first embodiment, but are mounted to the sash 20 or 30 as a single unit; however, the structure except for this point is substantially the same. That is, the latch devices 60 and 60A each has a latch bolt 61 which serves as a "fastening member", a helical spring 63 that urges the latch bolt 61 toward the side of the fastened position (toward the right in FIGS. 7 and 8) and hence serves as an "urging member", a case member 62 that guides the latch bolt 61, and a cover member 64 that supports the case member 62 and that is furnished with a guide hole 641 through which a knob 611 is passed, the knob 611 serving as an "operating member".

Further, as with the first embodiment, a first passage hole 211 or 311 and a second passage hole 231 or 331 that are not connected together are respectively formed in the upper frame element 21 or 31 and the vertical frame element 23 or 33 of the respective sash 20 or 30. As regards these latch devices 60 and 60A, the case member 62 is inserted into the frame element through the first passage hole 211 or 311, the tip-end side of the latch bolt 61 is made to project from the second passage hole 231 or 331 toward the side of the vertical frame member 13, and the cover member 64 is fixed to the upper frame element 21 or 31. More specifically, as shown in FIG. 6, indentations 621 are formed in the upper portion of the case member 62 on the side of the vertical frame element 23 or 33; after the case member 62 is passed through the first passage hole 211 or 311, the entire latch device 60 or 60A is slid toward the side of the vertical frame element 23 or 33, so that the tip-end side of the latch bolt 61 projects from the second passage hole 231 or 331. In the latch device 60, an elastically-deformable engaging piece 642, which serves as an "engaging member", is provided on the bottom surface of the cover member 64, and the latch device 60 is fixed by engaging the engaging piece 642 to an engaged hole 312 formed in the top surface of the upper frame element 21 or 31. On the other hand, the latch device 60A is fixed by screwing a screw 65 that passes through the cover member 64 from its top-surface side into the upper frame element 21 or 31.

The present embodiment attains effects substantially similar to those of the first embodiment:

(6) The latch device 60 or 60A is mounted by first inserting the case member 62 of the latch device 60 or 60A through the first passage hole 211 or 311, then making the latch bolt 61 project from the second passage hole 231 or 331, and finally fixing the cover member 64 to the upper frame element 21 or 31. Therefore, the task of mounting the latch devices 60 and 60A can be carried out easily without the need to provide large indentations at the intersecting portions between the upper frame elements 21 and 31 and the vertical frame elements 23 and 33.

(7) Further, by structuring the latch device such that the engaging piece 642 is engaged with and fixed to the engaged hole 312 of the upper frame element 21 or 31 as in the case of the latch device 60, it is possible to further facilitate the task of mounting the latch device 60.

Note that the present invention is not limited to the foregoing embodiments. Other structures/configurations that can achieve the objects of the invention are within the scope of the invention, and the invention also includes the following modified examples:

For example, in the foregoing embodiments, the vertically-sliding window 1 was structured having two movable sashes (i.e., the upper sash 20 and the lower sash 30) paired in the vertical direction. The invention, however, is not limited thereto, and the window may be structured having only one movable sash or having three or more movable sashes.

Figure 9:
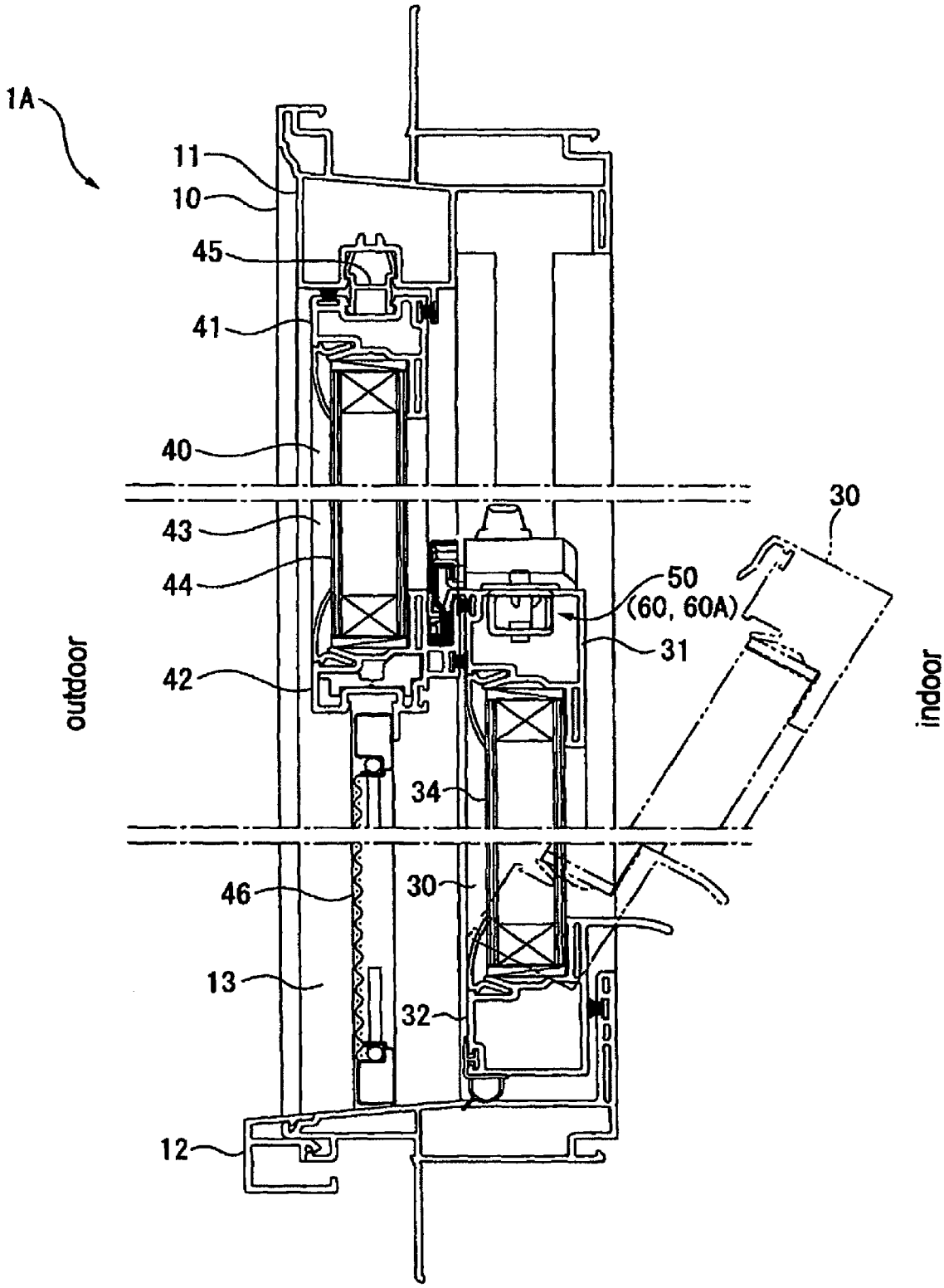
FIG. 9 is a vertical sectional view showing a sash window assembly according to a modified example of the present invention.

A single-hung vertically-sliding window 1A as that shown in FIG. 9 may be exemplified as a structure having a single movable sash.

More specifically, the vertically-sliding window 1A is structured having a window frame 10 and a lower sash 30 that are substantially the same as those of the foregoing embodiments, and in addition, an upper sash (fixed sash) 40 that is fixed to the window frame 10, and a screen window 46 that is fixed below the upper sash 40 and on the outdoor side of the lower sash 30. The upper sash 40 is formed by assembling an upper frame element 41, a lower frame element 42, and lateral (right and left) vertical frame elements 43, which are substantially the same as those used in the upper sash 20 of the foregoing embodiments, such that they constitute the four sides of a framing and fitting a glass panel 44 into the framing, but the upper frame element 41 and the vertical frame elements 43 are fixed, respectively, to the upper frame member 11 and the vertical frame members 13 through fixing members 45. In such a vertically-sliding window 1A, the lower sash 30 is structured such that it can be opened and closed by being slid vertically and that it can be tilted inward, and a latch device 50, 60, or 60A, which is similar to that described above, is mounted to each lateral end in the upper end portion of the lower sash 30 (i.e., the intersection between the upper end portion of the vertical frame element 33 and each lateral end portion (left end portion or right end portion) of the upper frame element 31).

Further, other than a window having a fixed sash 40 as that shown in FIG. 9, a window in which a face material such as a glass panel is directly fixed to the window frame 10 may be exemplified as a window having a single movable sash. Moreover, the sashes and/or face materials may have a structure in which they can be opened (and closed) by being tilted outward or by being pushed out.

Further, in the first embodiment, the latch device 50 is structured such that it is assembled by first inserting the latch bolt 51 into the case member 52 and inserting the latch body 56 through the second passage hole 231 or 331 for mating with the cover member 54, without the knob 55 of the latch device 50 being fixed to the latch bolt 51 (fastening member). The structure, however, is not limited to the above. That is, a knob may be mounted, in advance, to the fastening member in such a state that it can vertically project from and retract into the fastening member and that it is urged upward by a spring. With this structure, the knob may be retracted downward into the fastening member at the time of inserting the fastening member into the case member, or at the time of inserting the latch body through the second passage hole for mating with the cover member (supporting element). In this way, it is possible to carry out the mounting task with the knob attached to the latch body, thereby improving work efficiency.

Some of the best structures and methods for implementing the present invention have been disclosed in the above, but it should be noted that the present invention is not limited thereto. That is, although some specific embodiments of the present invention have been described and illustrated, those skilled in the art may make various modifications to the foregoing embodiments in terms of the form, materials, and numbers of structural components and in terms of other detailed structures, without departing from the scope of technical ideas and objects of the present invention.

Descriptions where the form, materials, etc., are limited to specific examples in the above disclosure have been given merely to facilitate understanding of the present invention, and the invention is not limited thereto. Accordingly, components that differ partially or entirely from those of the foregoing embodiments in terms of limitations regarding the form, materials, etc., and are thus named differently are also within the scope of the invention.

What is claimed is:

1. A sash window assembly comprising:

a window frame having an upper frame member, a lower frame member, and left and right vertical frame members; and at least one sash that is guided by the vertical frame members and supported so as to be openable and closable in a vertically slidable manner, the at least one sash having a latch device provided at one of left and right ends in an upper end portion of the at least one sash, the latch device having a latch body having a fastening member that is movably supported so as to project and retract between a fastened position and an unfastened position, wherein the fastened position is defined by the fastening member being fastened to one of the vertical frame members and the fastening member is capable of being slidably guided by a guide groove of the one of the vertical frame members, and wherein the unfastened position is defined by the fastening between the fastening member and the one of the vertical frame members being released, the latch device further having an urging member that urges the fastening member toward the fastened position, and a case member that guides the fastening member, the case member having a tubular portion through which the fastening member is passed and an enlarged-diameter portion that has an enlarged diameter through which an enlarged portion of the fastening member is passed, the enlarged diameter portion of the case member being provided with an engaging portion that engages with an inner side of one of a left and a right vertical frame element of the at least one sash, and an operating member that is capable of being operated to move the fastening member and a supporting element that mates with the latch body and that is capable of supporting the case member, the supporting element having a mating portion through which the tubular portion of the case member is passed, the at least one sash further having an upper frame element having a first passage hole that is formed in a top surface of the upper frame element, wherein the operating member of the latch device is exposed toward an indoor space by passing through the first passage hole, and a lower frame element, and the one of the left and right vertical frame elements having a second passage hole that is formed in a depth-direction surface of the one of the left and right vertical frame elements, wherein the fastening member is passed through the second passage hole, and a face material that is provided inside a framing made by assembling the upper frame element, the lower frame element, and the left and right vertical frame elements, the fastening member being provided with an engaging piece that is elastically deformable in a vertical direction, the engaging piece engaging with the case member at the fastened position and preventing the fastening member from projecting from the case member beyond the fastened position, the supporting element being inserted through the first passage hole, the latch body being inserted through the second passage hole, and the supporting element and the latch body mating with one another inside the upper frame element, the supporting element of the latch device having a top-surface portion that is arranged to be exposed from the upper frame element, an inserted portion that extends downward from the top-surface portion and that is inserted into the first passage hole, the guide hole being an elongated hole having a length extending along a direction of movement of the fastening member, the first passage hole and the second passage hole being formed in such a manner that they do not extend across a joint position between the upper frame element and the vertical frame element, the operating member being fixed into a fixing hole of the fastening member and movable along the direction of movement of the fastening member that is movable through the second passage hole, and the at least one sash being structured so as to be turnable toward the indoor space about a lower end portion thereof by operating the operating member and moving the fastening member to the unfastened position.

2. A sash window assembly according to claim 1, wherein:

the operating member passes through the guide hole of the supporting element and is fixed to the fastening member.

3. A sash window assembly according to claim 1, wherein:

the engaging portion of the case member engages with an edge of the second passage hole.

4. A sash window assembly comprising:

a window frame having an upper frame member, a lower frame member, and left and right vertical frame members; and at least one sash that is guided by the vertical frame members and supported so as to be openable and closable in a vertically slidable manner, the at least one sash having a latch device provided respectively at one of left and right ends in an upper end portion of the sash, the latch device having a latch body having a fastening member that is movably supported so as to project and retract between a fastened position and an unfastened position, wherein the fastened position is defined by when the fastening member is fastened to one of the vertical frame members and the fastening member is capable of being slidably guided by a guide groove of the one of the vertical frame members, and wherein the unfastened position is defined by when the fastening between the fastening member and the one of the vertical frame members is released, the latch device further having an urging member that urges the fastening member toward the fastened position, and a case member that guides the fastening member, the case member having a tubular portion through which the fastening member is passed and an enlarged-diameter portion that has an enlarged diameter through which an enlarged portion of the fastening member is passed, the enlarged diameter portion of the case member being provided with an engaging portion that engages with an inner side of one of a left and a right vertical frame element of the sash, and an operating member that is capable of being operated to move the fastening member, and a supporting element that mates with the latch body and that is capable of supporting the case member, the supporting element having a mating portion through which the tubular portion of the case member is passed, the at least one sash further having a framing having an upper frame element, a lower frame element, and the left and right vertical frame elements, the framing having a first passage hole that is formed in a top surface of the framing, wherein the operating member of the latch device is exposed toward an indoor space by passing through the first passage hole, the framing further having a second passage hole that is formed in a depth-direction surface of the framing wherein the fastening member of the latch device is passed through the second passage hole, and a face material that is provided inside the framing, the fastening member being provided with an engaging piece that is elastically deformable in a vertical direction, the engaging piece engaging with the case member at the fastened position and preventing the fastening member from projecting from the case member beyond the fastened position, the supporting element being inserted through the first passage hole, the latch body being inserted through the second passage hole, and the supporting element and the latch body mating with one another, inside the upper frame element, the supporting element of the latch device having a top-surface portion that is arranged to be exposed from the upper frame element, an inserted portion that extends downward from the respective top-surface portion and that is inserted into the first passage hole, and a guide hole that guides the operating member, the guide hole being an elongated hole having a length extending along a direction of movement of the fastening member, the first passage hole and the second passage hole being formed in such a manner that they do not extend across a joint position between the upper frame element and the vertical frame element, the operating member being fixed in a fixing hole of the fastening member, and the at least one sash being structured so as to be turnable toward the indoor space about a lower end portion thereof by operating the operating member and moving the fastening member to the unfastened position.

* * * * *